US005367895A

United States Patent [19]

Kadagies et al.

[11] Patent Number: 5,367,895

[45] Date of Patent: Nov. 29, 1994

[54] DEVICE FOR APPLYING A TREATMENT LIQUID TO A MOVING WEB OF MATERIAL, IN PARTICULAR A TEXTILE WEB

[75] Inventors: Klaus Kadagies, Krefeld; Walter Keller, Willich, both of Germany

[73] Assignee: Eduard Küsters Maschinenfabrik GmbH & Co. KG, Krefeld, Germany

[21] Appl. No.: 70,444

[22] PCT Filed: Oct. 22, 1991

[86] PCT No.: PCT/DE91/00822

§ 371 Date: Jun. 7, 1993

§ 102(e) Date: Jun. 7, 1993

[87] PCT Pub. No.: WO92/10603

PCT Pub. Date: Jun. 25, 1992

[30] Foreign Application Priority Data

Dec. 6, 1990 [DE] Germany ..... 4038874

[51] Int. Cl.[5] ..... D06B 3/18

[52] U.S. Cl. ..... 68/22; 68/45; 68/175; 118/405; 118/414

[58] Field of Search ..... 68/22 B, 43, 45, 99, 68/175; 118/405, 414; 162/318, 319, 358.3, 358.4

[56] References Cited

U.S. PATENT DOCUMENTS

| | | | |
|---|---|---|---|
| 2,562,457 | 7/1951 | Hannay et al. | 68/43 X |
| 2,729,192 | 1/1956 | Warner | 118/117 |
| 4,607,508 | 8/1986 | Sando et al. | 68/22 R |
| 4,740,305 | 4/1988 | Miller | 68/45 X |

FOREIGN PATENT DOCUMENTS

| | | |
|---|---|---|
| 0359174 | 10/1980 | Austria . |
| 0003790 | 9/1979 | European Pat. Off. . |
| 2126757 | 10/1972 | France . |
| 1078527 | 3/1960 | Germany . |
| 2048289 | 4/1972 | Germany . |
| 3103894 | 12/1982 | Germany . |
| 2935413 | 2/1986 | Germany . |
| 3010305 | 7/1987 | Germany . |

*Primary Examiner*—Philip R. Coe
*Attorney, Agent, or Firm*—Kenyon & Kenyon

[57] ABSTRACT

A device for applying a treatment liquid to a moving web of material such as a textile web includes a drum that is rotatable around a horizontal axis. At least one guide roller is provided for guiding the fabric web such that the web wraps at least partially around the drum beginning at a side of the drum at which the web is disposed tangentially thereto and continuing around a bottom portion of the drum. A trailing, continuous band is also provided which is closed in a liquid-tight manner and circulates in a plane that is perpendicular to the axis of the drum. The band has an outer circumferential surface that fits closely on the fabric web at a location in which the web contacts the drum. The circumferential surface of the band and drum define a nip therebetween. The band seals off the nip at its bottom. The band has web segments forming lateral sealing elements which extend from the edges of the band to project outwardly. The segments have a side abutting a contact surface formed at the rim of the drum. The segments, which also extend in a direction perpendicular to the axis of the drum, axially seal off the nip. A feed device is provided for supplying treatment liquid to maintain a predetermined filling level of treatment liquid in the nip.

20 Claims, 2 Drawing Sheets

DEVICE FOR APPLYING A TREATMENT LIQUID TO A MOVING WEB OF MATERIAL, IN PARTICULAR A TEXTILE WEB

BACKGROUND OF THE INVENTION

The invention relates generally to a device for applying a treatment liquid, and more particularly to a device for applying a treatment liquid to a moving web of material such as a textile web.

Such a device is disclosed in German Provisional Patent 10 78 527. In the particular device disclosed therein, the follower limiting element consists of a second drum, which is arranged at the same level as the first drum. The first and second drums form a roll nip through which the fabric web passes from top to bottom. The nip formed by the drum is filled up to a certain level with treatment liquid that is supplied from a supply disposed thereabove. The sealing elements are formed from stationary disks that sealingly abut against the front ends of the two drums.

The above-mentioned device is not suitable for all situations. A certain line pressure must be exerted along the roll nip to make it impermeable. This line pressure limits the quantity of liquid that is applied and, moreover, may attack the fabric web in a way that is not tolerated by all types of fabric. The stationary sealing elements at the ends of the nip, which the drums slide past, are susceptible to wear and must be replaced often if the configuration is to remain impermeable.

U.S. Pat. No. 2,729,192 discloses a coating device, in which the fabric web runs horizontally up against a drum and then runs down its side. In the downwardly directed area, a type of wiper abuts the fabric web or the drum. This wiper, in turn, borders on a nip in which treatment liquid is found, which then passes over on to the fabric web. The disadvantage of this device is that the fabric web only contacts the treatment liquid on one side. In addition, it is necessary to run the fabric web along the edge of the wiper, causing friction. To retain the impermeable nature of the nip, the contact force of the edge of the wiper must not exceed a certain value. The resulting friction is not tolerated by all fabrics, such as woven and knitted fabrics.

German Patent 29 35 413 discloses a coating device for foam in which the fabric web runs horizontally at the bottom onto a drum. The web wraps around this drum for at least 180°, and is then led away from the drum, returning to the top. In the lower region, a nip is formed by a boundary surface which is directed diagonally to the drum and which is limited at the lower end by a narrow gap. This narrow gap can be formed by a pipe or the like, which leaves a clearance space from the periphery of the drum. Foam that had been introduced into the nip is removed through this gap. The foam then forms a thin layer on the drum surface and is carried along until the fabric web is placed from the outside against the foam layer on the drum surface in the lower region of the drum. This device also has the capability of applying the foam on only one side. However, the device is not suitable for treatment liquids, because a treatment liquid does not retain its shape and would simply flow out through the gap at the lower end of the nip.

The present invention is directed to providing a device for applying a treatment liquid which is reliable in operation and which can apply the liquid to a sensitive fabric web.

SUMMARY OF THE INVENTION

The present invention provides a device for applying a treatment liquid to a moving web of material such as a textile web. The device includes a drum that is rotatable around a horizontal axis. At least one guide roller is provided for guiding the fabric web such that the web wraps at least partially around the drum beginning at a side of the drum at which the web is disposed tangentially thereto and continuing around a bottom portion of the drum. A trailing, continuous band is also provided which is closed in a liquid-tight manner and circulates in a plane that is perpendicular to the axis of the drum. The band has an outer circumferential surface that fits closely on the fabric web at a location in which the web contacts the drum. The circumferential surface of the band and drum define a nip therebetween. The band seals off the nip at its bottom. The band has web segments forming lateral sealing elements which extend from the edges of the band to project outwardly. The segments have a side abutting a contact surface formed at the rim of the drum. The segments, which also extend in a direction perpendicular to the axis of the drum, axially seal off the nip. A feed device is provided for supplying treatment liquid to maintain a predetermined filling level of treatment liquid in the nip.

While the two interacting drums in the known devices of this type exhibit an inherent stability and, therefore, require a certain line pressure to seal off the nip towards the bottom, in the present invention, the band clings by itself to the drum and seals off a well-defined, even if small, looping area. Because of its flexibility, the band automatically evens out irregularities in the web. Even next to the band, the web is not subject to any friction, but rather is taken along between uniformly moving boundary surfaces, namely the drum on the one hand and the band on the other hand, without the occurrence of significant relative motion. Any change in the width of the web can easily be overcome because of the flexibility of the band and because of the self-adjusting tight contact this flexibility allows with the drum beyond the width of the web.

It is advantageous to press the band on by a tension element so that the band tension does not have to be too high and further to ensure formation of uniform contact over the width of the web. This tension element can exert pressure against the drum which is uniform over the width of the web. This can be done, for example, with the help of pressure tubing, as disclosed in the German Patent 29 35 413.

It is particularly advantageous when the tension element follows the band (i.e., when the tension element is designed as a rotating roller having internal means for compensating for deformation).

It is also advantageous to combine the previously mentioned features of the invention with the following. Namely, the upright web segment projecting toward the drum at the edges of the band forms a follower sealing element, so that the problems associated with friction in the known devices are virtually eliminated, because relative movements hardly occur between the sealing element and the drum. Besides functioning as a seal in the axial direction, the web segment also functions to constantly center the band in the axial direction. This prevents the band from running improperly and eliminates the need for separate means to prevent it from running improperly.

In principle, the surface contacting the drum which is perpendicular to the axis may be formed by the front end of the drum or by a recess in the drum situated near its periphery. Band guidance is improved, however, when an edge of a circumferential groove provided at the edges of the drum forms the contact surface. In particular, the web segment and the groove should have the same cross-section. Furthermore, the cross-section can be wedge-shaped.

When the drum and the band rotate, the web segment enters into the groove, completely filling it at the narrowest point of the nip, thus ensuring excellent sealing action, especially near the most critical point. The device can also be designed so that the web segment fits into the groove with a certain preliminary tension when this groove is completely filled in. Because of the wedge shape, the web segment is easily removable from the groove.

DETAILED DESCRIPTION

Figure 1:
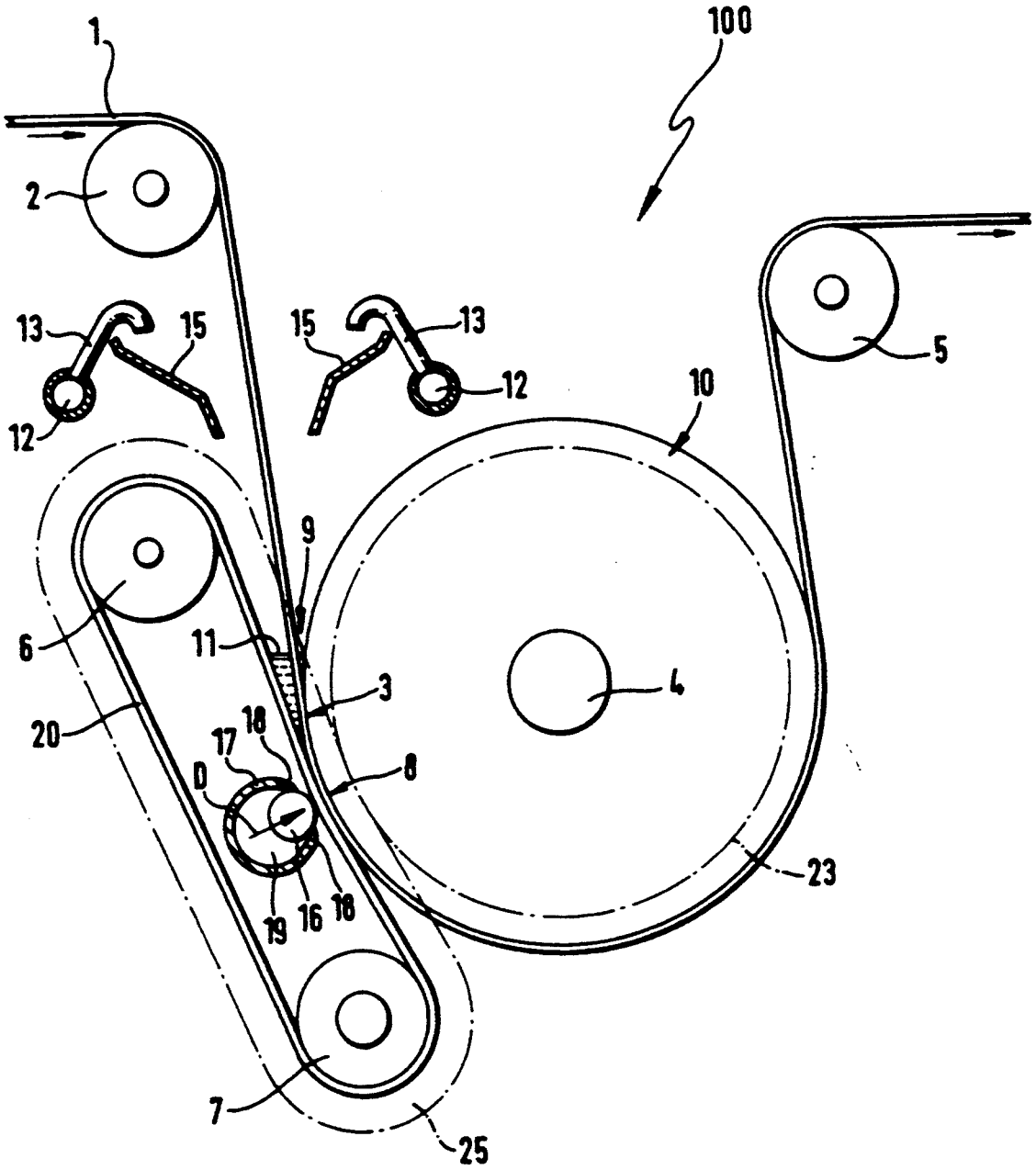
FIG. 1 shows a side view of the coating device constructed according to the principles of the present invention.

The device 100 shown in FIG. 1 is used to apply a treatment liquid, for example a liquid dye, to a fabric web 1. The web 1 is guided by means of a guide roller 2 vertically (or essentially vertically) downwards. In the area 3, more or less, the web 1 runs up on a side tangentially against a drum 10 having a closed surface. The drum 10, which is driven, revolves around a horizontal axle 4. The fabric web 1 traverses the circumference of the drum 10 for about 180° and is then further carried over another guide roller 5, first in an upward direction and then in a direction lateral thereto.

A continuous, circulating, closed band 20 formed of rubber or plastic is arranged on the side of the drum 10. The band 20 is tentered between two guide rollers 6 and 7. The guide roller 7 is a driven roller. The driving speed of the band 20 corresponds to the speed of the drum 10 at its periphery. The band 20 tangentially abuts the drum 10, somewhat below the run-up point 3 of the fabric web 1 (i.e., point 8). Coming from above, the fabric web 1 traverses a nip 9, starting at a point thereabove. Treatment liquid is supplied to the nip 9 up to a filling level 11. In the upper part of the nip 9, the fabric web 1 has not yet reached the drum 10. In this upper portion, the treatment liquid is applied to both sides of the fabric web.

The treatment liquid for the nip 9 is supplied through two feed tubes 12, which extend at right angles across the width of the web. Of these, two small tubes 13 are bent in the shape of a walking stick (i.e., j-shaped) and are arranged at short distances from one another in a row. The two small tubes 13 first extend upward and then bend downward to deliver liquid onto sloping run-off plates 15, from whose lower rim the liquid runs off into the nip 9. In this manner, the treatment liquid is delivered uniformly into the nip 9, even if the fabric web has a larger width.

The latter point is important, because the nip 9 contains only a minimum quantity of treatment liquid that is continually supplied in proportion to its consumption. It is not possible to compensate at a sufficiently fast rate to account for different filling levels 11 along the nip 9. Any variation in the filling level 11 would immediately become noticeable in a variation in the web's treatment-liquid coating in the lateral direction.

In the area of the contact point 8, the band 20 is braced from behind by a supporting element 16 having the form of a pipe. The pipe is arranged within a larger diameter pipe 17, which has a discontinuity forming an open slotted hole at one point along its length. The pipe protrudes radially outward from the slotted hole and is sealed off at the edges of the slotted hole at 18. The pipe may be rotatably supported.

An air chamber 19 into which compressed air is introduced exerts a uniform pressure D onto the pipe 16 and, consequently, onto the band 20.

Figure 2:
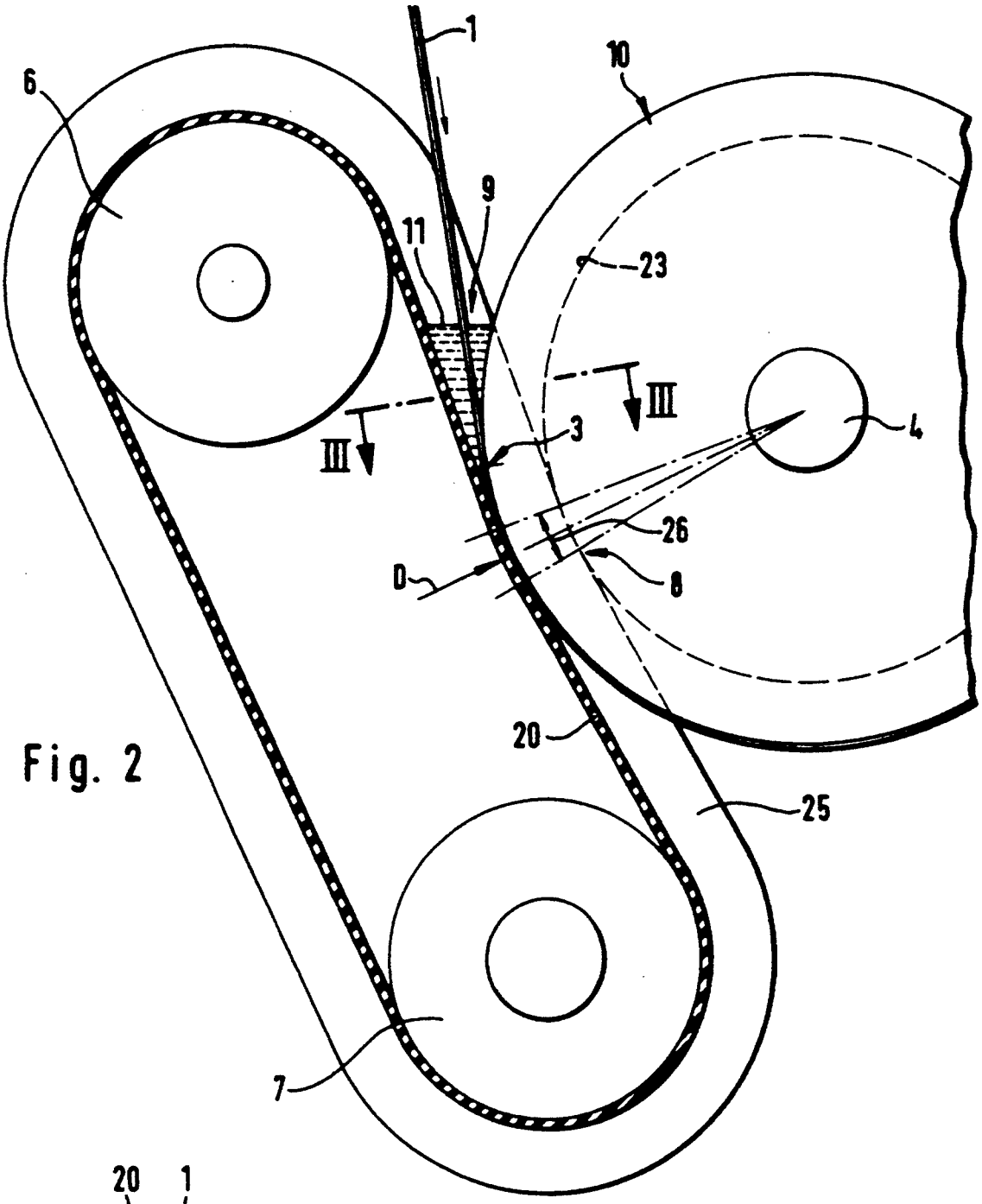
FIG. 2 illustrates a partial view of the nip area in an enlarged scale.
Figure 3:
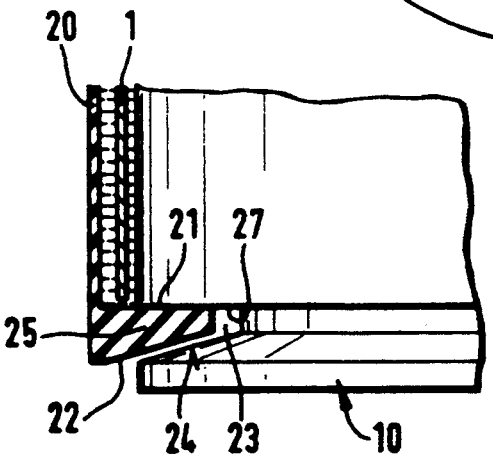
FIG. 3 illustrates a view taken along line III—III in FIG. 2, again in an enlarged scale.

An additional feature of the invention, which had only been alluded to in FIG. 1, is illustrated in FIGS. 2 and 3. Namely, at both longitudinal rims, the band 20 has web segments 25, which circulate in a closed cycle and extend upward from the band surface to project outwardly, so that the resulting cross-section of the band 20 is "u"-shaped (i.e., open to the outside). The mutually facing boundary surfaces 21 of the web segments 25 are situated in a plane that is perpendicular to the axis of the drum 10, while the outer edges 22 of the cross-section are oblique, producing the wedge-shaped configuration shown in FIG. 3.

The lateral web segments 25 project toward the drum 10 and mate with circular grooves 23 formed on the rim of the drum 10. The edge or lateral surface 21 of the web segment 25 perpendicular to the axis fits closely on a contact surface 27, which is also perpendicular to the axis of the drum and which in the illustrated embodiment corresponds to an edge of the groove 23. A slanting edge 24 of the groove 23 corresponds to the slanting lateral surface 22 of the web segment 25.

The cut-away portion of FIG. 3 is taken from a point situated upstream from point 3, (i.e., from a point where the fabric web has not yet completely reached the surface of the drum 10, as is discernable from FIG. 2). Thus, as seen in FIG. 2 and 3, at this point, the fabric web 1 is still surrounded on both sides by treatment liquid. However, in continuing its path, the fabric web 1 runs up against the drum 10 at point 3 and maintains this contact. At point 8, the band 20 also abuts from the outside against the fabric web 1 or the drum 10. Accordingly, the gap is sealingly closed on both sides of the fabric web 1. The web segment 25 has entered completely into the groove 23 on both edges of the band 20, and the edges 22 and 24 also fit tightly on one another. In this manner, the two-sided web segments 25 form the axial sealing elements for the nip 9. The height of the web segments 25 determines a maximum filling level 11, as is obvious from FIG. 2.

A certain displacement that entails friction does, in fact, occur at the edges 21 and 22. However, the amount of friction is substantially less than the friction that would be produced if the rim of the rotating drum 10 abutted a stationary sealing element.

In the area of point 8, where a tension element such as pipe 16 acts with a pressure D from the inside against the band 20, the band 20 abuts the periphery of the drum 10 over a certain small looping area 26, which in the embodiment of the invention that is illustrated represents about 10°. This feature improves the manner in which the nip 9 is sealed off at the bottom.

What is claimed is:

1. A device for applying a treatment liquid to a moving web of material, said device comprising:

a drum having a rim, said rim having an outwardly directed contact surface, said drum being rotatable around a horizontal axis;

at least one guide roller for guiding a fabric web such that the web wraps at least partially around said drum beginning at a side of said drum at which the web is disposed tangentially thereto and continuing around a bottom portion of said drum;

a trailing, continuous band closed in a liquid-tight manner and circulating in a plane that is perpendicular to the axis of said drum, said band having an outer circumferential surface that fits closely on the fabric web at a location in which the web contacts said drum, said circumferential surface of the band and drum defining a nip therebetween, said band sealing off the nip at its bottom;

said band having a web segments forming lateral sealing elements which extend from edges of the band to project outwardly, said segments having a side abutting the outwardly directed contact surface formed at the rim of the drum, said segments extending in a direction perpendicular to the axis of the drum, said segment axially sealing off said nip; and a feed device for supplying treatment liquid to maintain a predetermined filling level of treatment liquid in said nip.

2. The device according to claim 1 further comprising a groove extending around the rim of the drum, said contact surface being formed by one edge of the groove.

3. The device of claim 2 wherein said web segment and said groove have substantially the same cross-section.

4. The device of claim 3 wherein in a region near the contact surface, the web segment and the groove are delimited at an angle formed in a plane extending perpendicular to the axis of the drum, the web segment and the groove being tapered to a wedge shape, said taper extending toward a base of the groove.

5. The device of claim 2 further comprising a tension element extending parallel to the axis of the drum and abutting against the drum from a region within the closed band.

6. The device of claim 5 wherein the tension element exerts a pressure against the drum that is substantially uniform over the width of the fabric web.

7. The device of claim 6 wherein the tension element follows the band at a point where the tension element abuts the drum.

8. The device of claim 5 wherein the tension element follows the band at a point where the tension element abuts the drum.

9. The device of claim 3 further comprising a tension element extending parallel to the axis of the drum and abutting against the drum from a region within the closed band.

10. The device of claim 9 wherein the tension element exerts a pressure against the drum that is substantially uniform over the width of the fabric web.

11. The device of claim 10 wherein the tension element follows the band at a point where the tension element abuts the drum.

12. The device of claim 1 further comprising a tension element extending parallel to the axis of the drum and abutting against the drum from a region within the closed band.

13. The device of claim 12 wherein the tension element exerts a pressure against the drum that is substantially uniform over the width of the fabric web.

14. The device of claim 13 wherein the tension element follows the band at a point where the tension element abuts the drum.

15. The device of claim 12 wherein the tension element follows the band at a point where the tension element abuts the drum.

16. A device for applying a treatment liquid to a moving web of material, said device comprising:

a drum having a rim and a groove, said groove extending around the rim of the drum, said drum rotatable around a horizontal axis;

at least one guide roller for guiding a fabric web such that the web wraps at least partially around said drum beginning at a side of said drum at which the web is disposed tangentially thereto and continuing around a bottom portion of said drum;

a trailing, continuous band closed in a liquid-tight manner and circulating in a plane that is perpendicular to the axis of said drum, said band having an outer circumferential surface that fits closely on the fabric web at a location in which the web contacts said drum, said circumferential surface of the band and drum defining a nip therebetween, said band sealing off the nip at its bottom;

said band having web segments forming lateral sealing elements which extend from edges of the band to project outwardly, said segments having a side abutting a contact surface formed at the rim of the drum by one edge of the groove, said segments extending in a direction perpendicular to the axis of the drum, said segment axially sealing off said nip; and a feed device for supplying treatment liquid to maintain a predetermined filling level of treatment liquid in said nip, wherein in a region near the contact surface, the web segment and the groove are delimited at an angle formed in a plane extending perpendicular to the axis of the drum, the web segment and the groove being tapered to a wedge shape, said taper extending toward a base of the groove.

17. The device of claim 16 further comprising a tension element extending parallel to the axis of the drum and abutting against the drum from a region within the closed band.

18. The device of claim 17 wherein the tension element exerts a pressure against the drum that is substantially uniform over the width of the fabric web.

19. The device of claim 18 wherein the tension element follows the band at a point where the tension element abuts the drum.

20. The device of claim 17 wherein the tension element follows the band at a point where the tension element abuts the drum.

* * * * *